US005992499A

United States Patent [19]

Tordoff et al.

[11] Patent Number: 5,992,499

[45] Date of Patent: Nov. 30, 1999

[54] METHOD FOR COLD RECLAMATION OF FOUNDRY SAND CONTAINING CLAY

[75] Inventors: William Lee Tordoff, Dublin, Ohio; Jeremy Paul Miller, Reading, United Kingdom

[73] Assignees: Air Products and Chemicals, Inc., Allentown, Pa.; American Metalcasting Services Int'l Inc., Dublin, Ohio

[21] Appl. No.: 09/037,112

[22] Filed: Mar. 9, 1998

Related U.S. Application Data

[63] Continuation-in-part of application No. 08/855,733, May 9, 1997, abandoned.

[51] Int. Cl.[6] ..... B22C 5/00; B22C 5/08

[52] U.S. Cl. ..... 164/5; 241/23; 241/DIG. 10; 241/DIG. 37

[58] Field of Search ..... 164/5; 241/23, 241/DIG. 10, DIG. 37

[56] References Cited

U.S. PATENT DOCUMENTS

| | | | |
|---|---|---|---|
| 4,334,574 | 6/1982 | Rennie et al. | 164/5 X |
| 5,219,123 | 6/1993 | Jacob . | |

FOREIGN PATENT DOCUMENTS

| | | | |
|---|---|---|---|
| 55-40061 | 3/1980 | Japan | 164/5 |
| 56-131040 | 10/1981 | Japan | 164/5 |
| 4-319040 | 11/1992 | Japan | 164/5 |
| 2031313 | 4/1980 | United Kingdom | 241/275 |

OTHER PUBLICATIONS

"If It's Black, Why Do They Call It Sand" by D. F. Hoyt, AFS Transactions 1995, vol. 103, pp. 353–360 (#95–100).

"Scanning Electron Microscope and Sand–Binder Studies: A 25–Year Review" by R. H. Toeniskoetter, AFS Transactions 1995, vol. 103, pp. 477–486 (#95–144).

"Sand Reclamation Project: Saginaw Malleable Iron Plant, GM Powertrain Group" by D. J. Couture, R. L. Havercroft and L. L. Stahl, AFS Transaction 1995, pp. 783–790 (#95–141).

"Evaluation of Reclaimed Green Sand for Use in Various Core Processes" by S. E. Clark, C. W. Thoman, R. H. Sheppard, R. Williams and M. B. Krysiak, AFS Transactions 1994 vol. 102, pp. 1–12 (#94–02).

"Thermal Reclamation The Evidence Against It" by D. S. Leidel, AFS Transactions 1994, vol. 102, pp. 443–453 (#94–10).

"Sand Binder Systems" Ashland Chemical Company, Foundry Management Technology (1996).

*Primary Examiner*—J. Reed Batten, Jr.
*Attorney, Agent, or Firm*—Ratner & Prestia

[57] ABSTRACT

Method and apparatus for reclaiming sand from a foundry sand containing, inter alia, a clay binder by cooling the foundry sand to a temperature at or below −40° C. (−40° F.) followed by separation of the sand from the binder while the sand is maintained at a temperature at or below 0° C. (32° F.). Foundry sands with clay binders have a water content to 1% to 15% by weight prior to being cooled.

17 Claims, 4 Drawing Sheets

METHOD FOR COLD RECLAMATION OF FOUNDRY SAND CONTAINING CLAY

CROSS REFERENCE TO RELATED APPLICATION

This application is a continuation-in-part of U.S. patent application Ser. No. 08/855,733 filed May 9, 1997, and now abandoned.

STATEMENT REGARDING FEDERALLY SPONSORED RESEARCH OR DEVELOPMENT

BACKGROUND OF THE INVENTION

The present invention pertains to reclaiming foundry sand, be it green sand or sand used in molded cores for reuse or safe disposal.

In the production of certain types of metal castings, large or small, e.g. aluminum, iron or steel, the casting mold is prepared by the application of suitable binders or adhesives to specifically sized aggregates such as silica sand, specialty sands or synthetic sands. The adhesives most commonly used include natural clays activated by water and inorganic and organic resins cured by various catalysts, such as acids, bases or heat activation. In the founder's lexicon, the term "green sand" refers to sand that is bonded with a mixture of clay and water. Water is added in specified amounts to activate the fine ground clay which has been mixed with the specially prepared aggregate, sand. This homogeneous mixture of sand which has been coated with water activated clay is then applied to patterns using pressure, vibration or other means of compaction to form the container or "mold" into which molten metal is poured to form the casting.

Alternatively to clay/water adhesives, the use of synthetic organic and inorganic resins are commonly used to prepare molds capable of withstanding the regors of the metal casting process. In the preparation of resin bonded sand molds, washed and dried aggregates such as silica sand, lake sand, synthetic aggregates, specialty sands such as olivene, chromite and Zircon sands are mixed with resins in mullers, batch mixers or continuous mixers to coat the aggregate particles with the resins. Curing or hardening of the resin films or adhesives which coat the sand grains can be achieved in a wide variety of methods including, catalysis, heat, or through the use of gases or vapors. Some resin systems employed can also be autocatalytic or self setting.

The terminology "green sand" describes the natural state of clay/water activated adhesives since it is similar to green ware in ceramics or wood, where the term green means that the ceramic has not been fired or dried in a kiln or oven. In the case of wood, the wood has not been subjected to a drying operation to reduce its moisture content. In addition to sand, the aggregates, which can be silica, zircon, chromite, olivine, ceramic or synthetic, and the clay binder, which can be western bentonite, southern bentonite or other clays such as fire clay, the foundry sand may also contain additives such as cereal, in the form of corn, milo, wheat and rye flours, cellulose in the form of finely ground wood flour, oat hulls, rice hulls and ground nut shells, carbon in the form of seacoal, (low sulfur coal), gilsonite, lignite and polymers or chemicals, such as water, or polymers, wetting agents, soda ash and iron oxide to name a few.

The foundry process also includes the use of bonded aggregates to produce cores or shaped sand necessary to form the internal passages or surfaces. The same sand that is used to make the mold can also be used to make cores which are placed in the mold to achieve hollows, slots, passages, holes and the like in the finished castings. Cores are generally made from new sand since the presence of contaminates such as clays, fines, water or organic and inorganic materials interfere with the adhesives bonding mechanism chemically or physically. Synthetic sands may also be employed to impart special characteristics to the cores when they are exposed to the casting process. Again, as in the production of resin bonded molds, adhesives or resins are coated on washed and dried specifically sized aggregates which are cured through a variety of methods described above for molding with resin systems. Examples of no bake binders are furan and phenolic/acid cured systems, phenolic/ester cured systems, alkyd oil urethanes, alumina phosphate, and silicate/ester mixtures. Examples of cold box binders are acrylic epoxy SO2, (free radical or acid cured), furan SO2, phenolic urethane amine cured systems, ester cured alkaline phenolics, sodium silicate CO2 and phenolic CO2 cured systems. Examples of heat cured binders are hot box-furan and phenolic resins, warm box-furan and phenolic, shell, core oil and aluminate silicates.

In the manufacture of castings, after the molten metal is poured into the mold and solidification has occurred, the mold is subjected to "shake-out". Shake-out refers to the separation of the sand from the casting(s). The casting is then sent to various finishing operations and the sand is subject to either reclamation, reuse or disposal.

The most prevalent foundry molding method used is the green sand process followed by chemically bonded no-bake molding. Green sand molding without insertion or use of cores allows the mixture of sand, cereal, clay, water, seacoal, etc. to be reactivated through the addition of new clay, water and additives in mixers or mullers. However, new sand must be added to replace the sand lost in the casting process since handling, high temperatures and fracturing of the sand can occur.

In the case of castings which have internal passages or those which are hollow, the use of cores adds sand to the system or green sand which dilutes the clay bonded sand. Again, additions of clay, water, seacoal etc. must be made to maintain the desired properties of the green sand system.

Since most castings made in green sand systems and no-bake or chemically bonded molding require cores, the ability to reclaim the used or spent sand would be extremely desirable. In the past, disposal of foundry sand in a landfill site was one way of disposing of the sand after the shake-out operation. However, because of the ever changing environmental rules and regulations and the increasing costs for acquisition, preparation and delivery of new sand, efforts have been focused on the reclamation and reuse of sand and aggregates used in the casting process.

Attempts to reclaim sand for use within the foundry have not been successful for a variety of reasons. While green sand can be reprocessed for re-use in clay bonded molding sand, the reclamation of clay bonded sand has not been successful for a variety of physical and chemical reasons. These include alterations to grain fineness number, particle size distribution, contamination, moisture, changes in pH or acid demand value, and surface area changes to name a few.

Attempts to reclaim bentonite or clay bonded systems have included attrition, washing and thermal treatment. The most prevalent method of reclaiming sand values from foundry sand is through the application of mechanical treatment, thermal treatment or combinations of both. Thermal units typically employ infrared or gas fired thermal sources. In the traditional process for green sand reclamation, the ionic bond of clay systems is deactivated by calcination of the clay. The calcined clay, known as dead clay, can then be stripped from the sand by mechanical means, e.g. by high energy pneumatic stripping which impacts a stream of sand on a target and mechanically blasts the clay particles from the sand grain, or by imparting energy in the form of attrition, scrubbing or subjecting the particles to mechanical treatment.

Physical abrasion of the agglomerated and individual sand grains does not remove all of the adhesives from the sand particles since the irregular shapes on the sand surface do not always unlock the entrapped clay or resin particles. This, combined with the fact that the mechanical stripping results in a change in the particle size distribution of the sand so that the particle size distribution must be readjusted with the addition of new sand additions to maintain the desired size distribution. Too fine or coarse particle distribution results in inferior molding properties and can produce adverse affects upon the castings produced, such as, gas related and metal penetration defects.

Thermal reclamation of green sand or resin bonded sands typically operate at temperatures in excess of 1600 degrees F. (871° C.) for bentonite bonded and inorganic bonded sands and in excess of 900° F. for organic based adhesive systems. The process of thermal reclamation includes both heating and cooling followed by mechanical stripping, sand cooling and classification of the sand for reblending or rebonding. The overall process can result in a sand fraction that may not meet original specifications and a waste stream of silica fines and dead clay, all of which must be disposed of in a landfill or by other environmentally acceptable means.

A second type of reclamation is the use of mechanical attrition to mechanically breakdown the lumps or agglomerated sand particles into individual sand grains when resins or adhesives are used in place of clay bonded systems. Although mechanically reclaimed sand can be used in most chemically bonded systems, the returned or reclaimed sand typically contains residues of resin and carbonaceous materials which interfere with rebonding of the sand or produce undesirable casting conditions. The presence of residuals not removed by mechanical reclamation increase the fineness of the sand which typically requires greater levels of binder additions to maintain equivalent strength for handling and pouring. In addition, the higher levels of adhesives in the system can contribute to casting defects.

In a thermal process it is typical that about 1 million Btu's of energy be consumed per ton of reclaimed sand. In addition to the heat energy, energy must be expended to cool and classify the sand as well as to provide for whatever environmental regulations require. In many instances, thermally treated sand may require additions of chemicals to alter the pH and acid demand value of the sand to make it suitable for reuse in the core production area or in chemically bonded systems.

Thermal processes work well on most chemically bonded sands, but as stated above, do not work as well on clay bonded systems. Numerous schemes have been used to provide exposure of the sand to the source of heat, such as rotary kilns, fluidized beds and mechanical stirring. All of the thermal reclamation systems are sensitive to sand composition, binders and the amount of metallic oxides present in the sand, regardless of how the sand is heated. Thermal reclamation units require periodic relining and extensive environmental regulations govern their use. For example, calciners have been classified as fluid bed incinerators rather than reclaimers, thus requiring the operators to respond to different and more stringent environmental rules and regulations. It is estimated that, on average, to construct and verify operability of a thermal reclamation system will cost an operator about 500 thousand dollars per ton of capacity per hour of operation.

Additional discussions of foundry sands, binder systems and additives can be found in a series of papers published in AFS Transactions of the American Foundry Society. These are "If it's Black, Why do they scall it Green Sand" by D. F. Hoyt, AFS Transactions 1995, Vol. 103, Pages 353–369 (#95–100), "Scanning Electron Microscope and Sand-Binder Studies: A 25-Year Review" by R. H. Toeniskoetter, AFS Transactions 1995, Vol. 103, Pages 477–486 (#95–144), "Sand Reclamation Project: Saginaw Malleable Iron Plant, GM Powertrain Group" by D. J. Couture, R. L. Havercroft and L. L. Stahl, AFS Transactions 1995, Pages 783–790 (#95–141), "Evaluation of Reclaimed Green Sand for Use in Various Core Processes" by S. E. Clark, C. W. Thoman, R. H. Sheppard, R. Williams and M. B. Krysiak, AFS Transactions 1994 Vol. 102, Pages 1–12 (#94-02) and "Thermal Reclamation The Evidence Against It" by D. S. Leidel, AFS Transactions 1994, Vol 102, Pages 443–453 (94-10).

Ashland Chemical Company has collected thirteen additional papers in a re-print publication titled Sand Binder Systems under the cover Foundry Management & Technology (1996).

Therefore, there is a need for yet another method of reclaiming foundry sand.

BRIEF SUMMARY OF THE INVENTION

It has been discovered that sand suitable for use in preparation of green sand molds or molded cores can be reclaimed from foundry sand recovered during the shake out process, regardless of whether the foundry sand is used green sand or is sand contained in used cores. In its broadest form the invention reclaims the used foundry sand (used green sand with or without used cores) by cooling the used sand to a temperature at or below 0° C. (32° F.) and thereafter subjecting the sand to a separation or liberation of sand from the binder or other elements present in the sand that have not been consumed in the casting operation, the separation taking place while the used foundry sand is maintained at a temperature of at or below 0° C. (32° F.). Separation of the sand can be accomplished by subjecting the cooled used foundry sand to a separation, e.g. fluid classification, screening, etc. where the handling of the used foundry sand can cause separation of the sand from the binder or other elements. Optionally the cooled used foundry sand can be first subjected to mechanical attrition to enhance separation of the sand from the binder or other elements. Cooling of the used foundry sand can be accomplished by heat exchange with a cooling medium, e.g. air cooled by mechanical refrigeration, a cryogenic liquid, or cold gaseous cryogen, e.g. nitrogen.

According to one embodiment of the present invention, the used foundry sand (used green sand with or without used cores) is cooled to a temperature of −40° C. (−40° F.) or below and maintained at low temperature while it is subjected to an impact or abrasive treatment to liberate the sand from the binder and any other elements present in the sand that have not been consumed during the casting operation. Furthermore, maintaining refrigeration during separation following attrition, leads to recovery of sand which is suitable for use in core making as well as recovery of clay particles for use in green sand making as well as unreacted particles, e.g. seacoal, which can be reused by the foundry. Since the process of the invention does not require calcining of the foundry sand, organic particles, e.g. seacoal can be recovered for reuse along with the sand and clay particles.

According to one aspect of the present invention rotary tunnels can be used to effect initial heat exchange of the foundry sand with a cold gas, e.g. nitrogen, to reduce the temperature of the foundry sand prior to attrition. As used herein foundry sand is taken to mean green sand with or without core sand. The foundry sand can be subject to attrition followed by a screening to separate out the binders, other additives and fine sand particles. Thereafter, the reclaimed sand can be passed through another rotary tunnel for contact with re-circulating gas to recover the refrigeration values in the reclaimed sand as it is brought to ambient temperature. Liquid nitrogen can be injected into a recycle device or into the initial contact device in order to reduce the temperature of the sand to −40° C. (−40° F.) or below. In a like manner liquid nitrogen can be introduced in any of the processing equipment downstream of the refrigeration recovery device in order to maintain the required refrigeration capacity in the initial contact device, e.g. tunnel.

BRIEF DESCRIPTION OF THE SEVERAL VIEW OF THE DRAWINGS

DETAILED DESCRIPTION OF THE INVENTION

Figure 1:
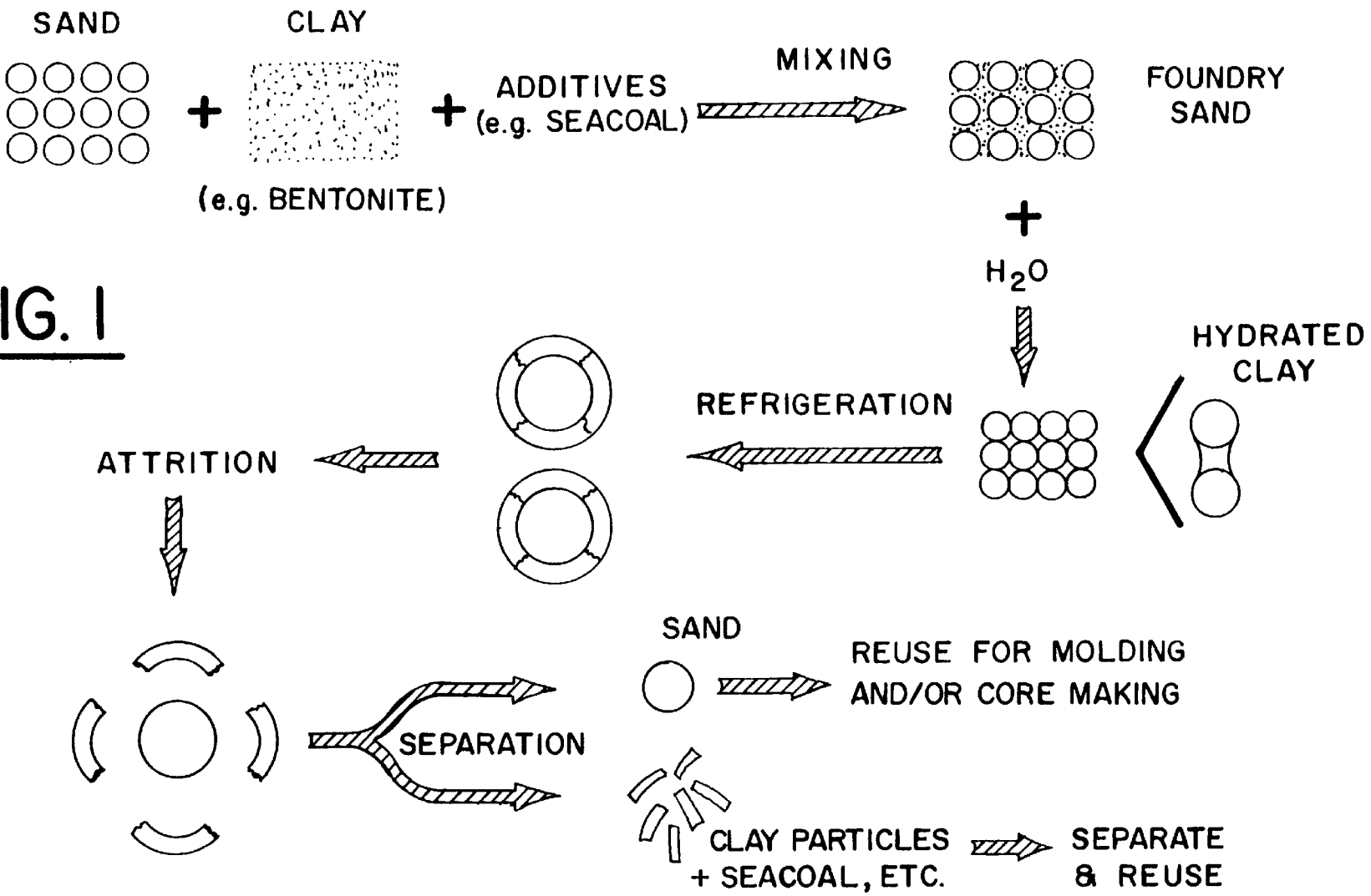
FIG. 1, is a schematic pictorial representation of sand reclamation from a clay bonded sand.

Referring to FIG. 1, a sand, e.g. silica sand is mixed with a clay binder, e.g. bentonite clay, and other additives such as seacoal, to produce the foundry sand. The foundry sand can then be used to prepare a mold for casting. After the casting operation, the moisture content of the foundry sand is adjusted by the addition of water which forms hydrated clay encapsulating or attached to the sand particles. As refrigeration is applied to the hydrated clay the water expands and eventually turns to ice. As the refrigerated particles are subjected to separation, with or without mechanical attrition the clay particles separate from the sand. Separation under refrigeration results in a sand fraction cleaned of the clay, which can be reused for molding and or core making and a separate stream of clay particles plus additives, e.g. seacoal which has not been burned during the casting process, and fine sand particles which in turn can be separated, the clay and seacoal reused and the fine sand particles disposed of in an environmentally safe manner.

It has been discovered that in its basic form the present invention can be put into practice by taking the used foundry sand containing a binder, with or without the other additives noted above, cooling the used foundry sand to a temperature of at or below 0° C. (32° F.) followed by separation of the binder and other additive particles from the sand while the used foundry sand is maintained at a temperature of 0° C. (32° F.). Separation of the binder and other additives from the sand can be effected by classification techniques (e.g. fluid classification, screening, etc.). If necessary the cold sand can be subjected to pre-separation treatment, e.g. attrition, to enhance separation of the binder and additive(s) from the sand. Pre-separation treatment may not be required where the normal handling during classification results in the necessary separation. Attrition can be accomplished using any of the well known devices or methods. Cooling of the used foundry sand initially and during separation can take place by heat exchange with cold gaseous mediums, e.g. air, nitrogen, etc., or with a liquid cryogen, e.g. liquid nitrogen. Cooling of the gaseous medium can be effected by mechanical refrigeration, or heat exchange with a colder gas, liquid cryogen or by evaporation from a low temperature liquid phase of the cooling medium.

Figure 2:
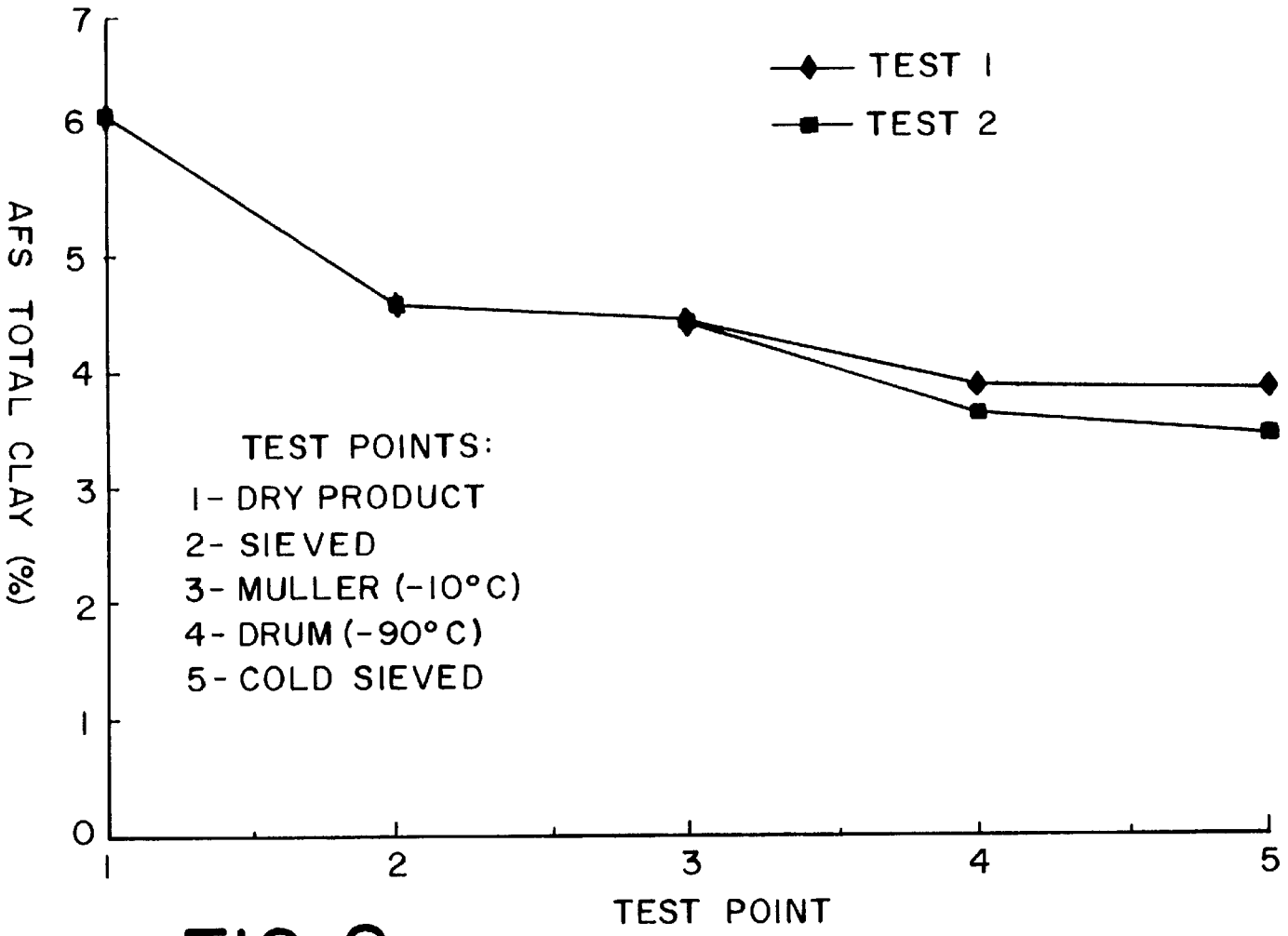
FIG. 2, is a plot of AFS Total Clay against various test points for a foundry green sand processed according to the invention.

FIG. 2 is a plot of AFS (American Foundry Society) Total Clay in percent by weight against specific test points for a used green sand taken from a commercial foundry. The used green sand was tested for the clay content at five intervals during processing to separate the clay binder from the green sand. The test points, as shown in FIG. 2 were: (1) the dry product at a temperature of about 15° C. (59° F.); (2) sand after separation by screening (sieving); (3) the sand exiting a sand muller, the sand at −10° C., (14° F.); (4) the sand after introduction into a rotary drum cvooled to −90° C. (−130° F.); and (5) the sand cold sieved after exiting the rotary drum the sand at a temperature of approximately −80° C. (−112° F.). The plot of FIG. 2 confirms that separation of clay binder from a foundry green sand is dramatically improved by cooling to a temperature below 0° C. (32F.).

Figure 3:
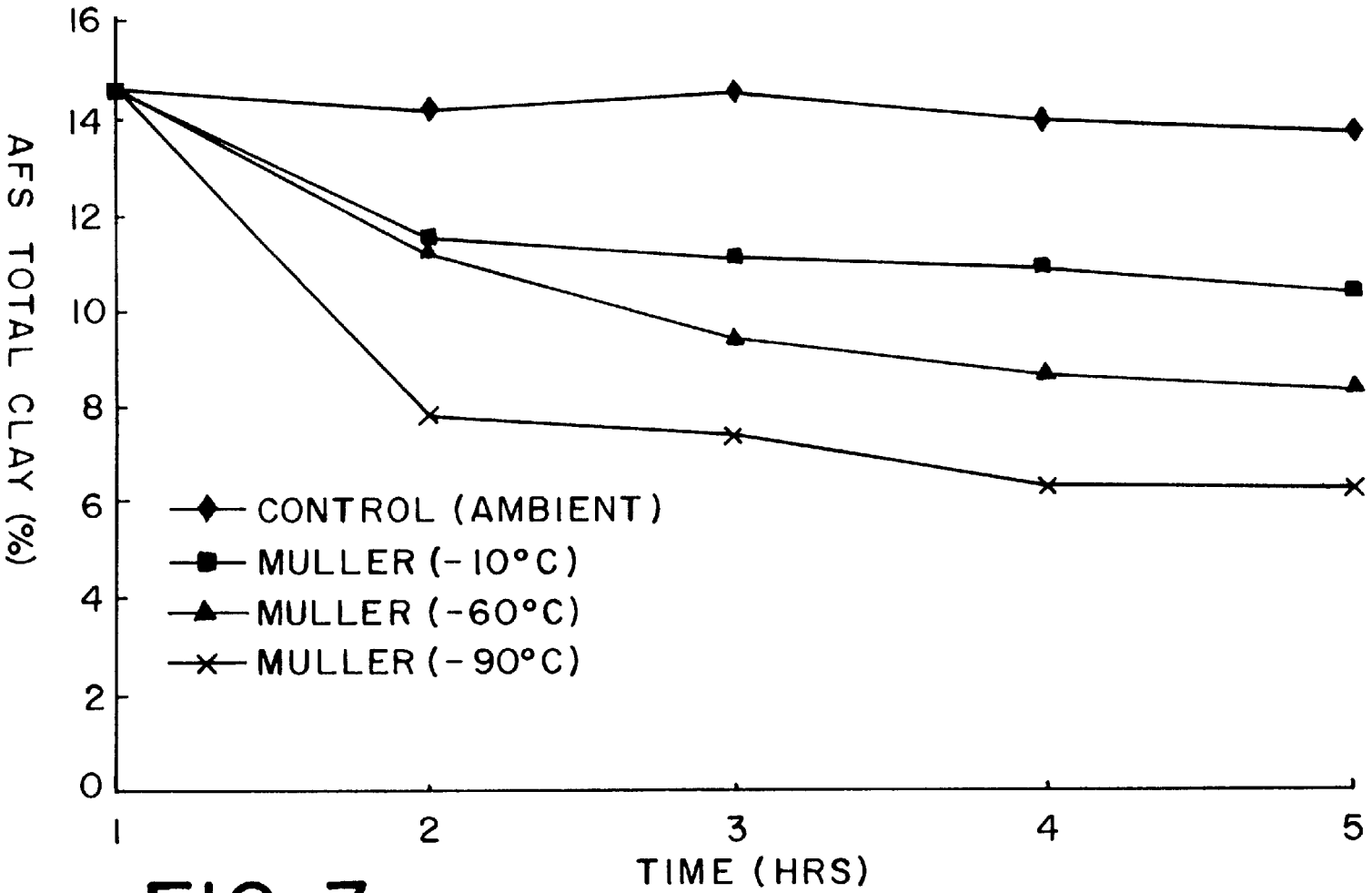
FIG. 3, is a plot of AFS Total Clay against time for samples taken during a mulling operation on green foundry sand with the muller at different temperatures.

FIG. 3, is a plot of AFS Total Clay in weight percent against time for sample of a commercial green foundry sand taken during a mulling operation with the muller at ambient temperature [about 15° C. (59° F.)], −10° C. (14° F.), −60° C. (−76° F.) and −90° C. (−130° F.). The curves of FIG. 2 demonstrate cooling a used green foundry sand to temperatures below 0° C. (32° F.) results in a significant separation of clay binder from the sand.

Figure 4:
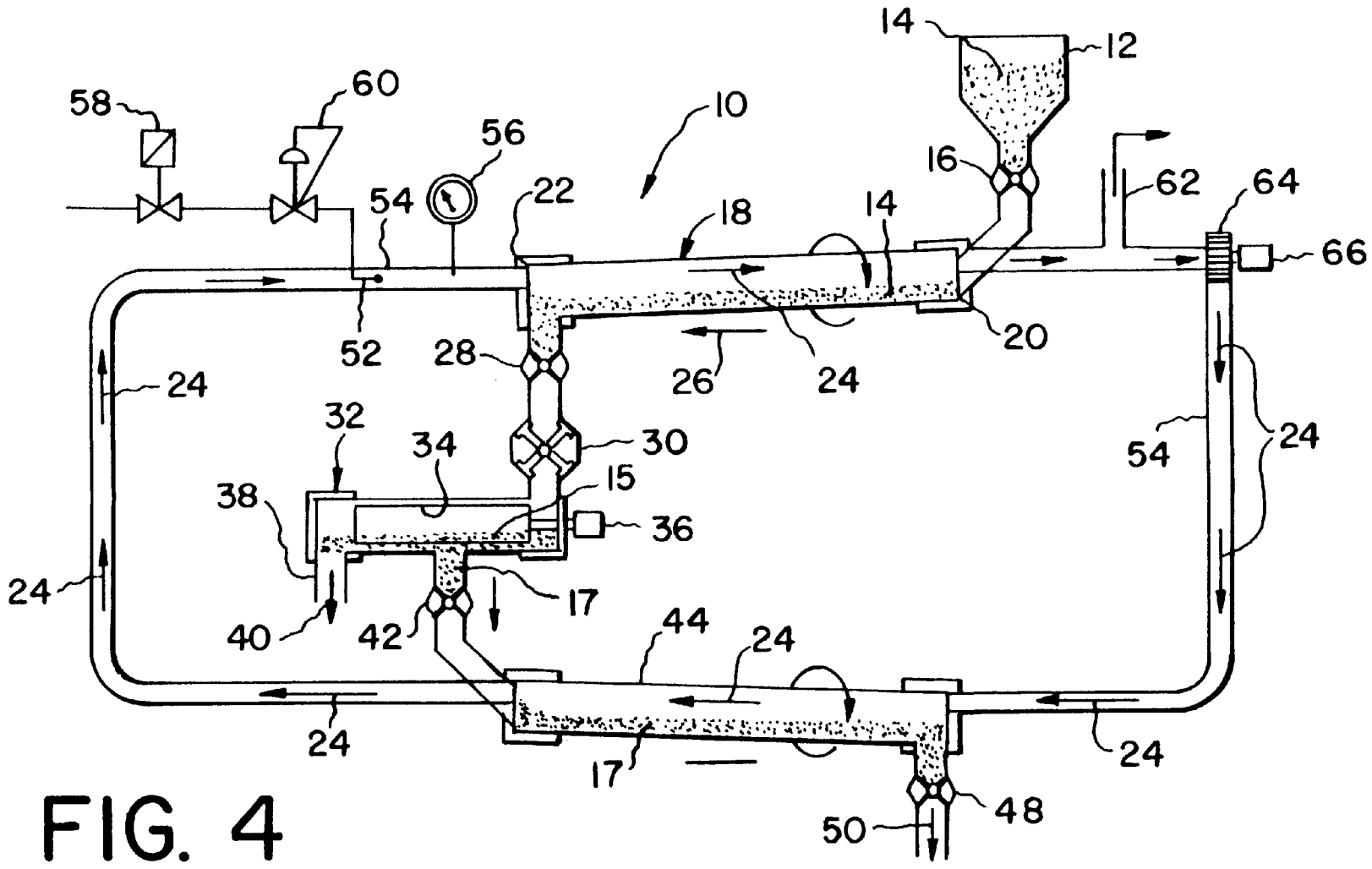
FIG. 4, is a schematic diagram illustrating the process and aparator of present invention.

Referring to FIG. 4, according to one aspect the process of the present invention can be embodied in an apparatus shown generally as 10, which includes a feed hopper 12 to contain the foundry sand 14. Foundry sand 14 is fed through a rotary valve or other gating device 16 into a first rotary tunnel 18 where it proceeds from an entry end 20 to a discharge end 22 as is well known by those who use rotary kilns or rotary tunnels. A refrigerant medium, preferably a liquid or gaseous cryogen (e.g. cooled nitrogen gas), represented by arrow 24, is fed in counter flow relationship to the movement of the sand, which is represented by arrow 26, through the tunnel 18. As the foundry sand 14 moves through the tunnel 18 it is cooled to a temperature of −40° C. (−40° F.) or below and preferably to below −80° C. (−112° F.). Cooled foundry sand exiting tunnel 18 at discharge end 22 can be metered through a rotary valve or other gate device 28 to the entry of an attrition device (e.g. impact blaster) 30 where the sand particles are separated from the binder. The product 15 of the attrition step 30 is classified using a rotary sieve 32 which includes a rotating screen 34 rotated by a suitable motor 36 as is well known in the art. The product of the rotary screen 34 is silica sand 17 which has been cleaned of clay and fines which exit from a discharge port 38 of rotary sieve 32 as shown by arrow 40. The recovered silica sand 15 passes through a rotary valve or gate device 42 to a heat recovery device 44.

In heat recovery device 44, which can be another rotating tunnel, the recovered silica sand 15 is passed in heat exchange with re-circulating gas (e.g. nitrogen) 24 so that the refrigeration value in the sand 17 is imparted to the re-circulating nitrogen gas 24. Once the cleaned sand 17 passes through the heat recovery device 44 in counter flow to the re-circulating nitrogen gas, the product at ambient temperature can be removed through a rotary valve or gate device 48 as indicated by product arrow 50. The cleaned or reclaimed sand 50 is ready for reuse, either as a green sand material, or as a core or mold sand material. The refrigerated nitrogen gas shown by arrows 24 is re-circulated to the initial refrigeration contact device (tunnel) 18 to cool incoming foundry sand 14. A liquid nitrogen spray device 52 can be included in the recycle loop 54 in order to adjust the temperature of the gas inside the rotary tunnel 18. The recycle loop can include conventional temperature probes 56 and flow control valves 58, 60 in order to adjust the temperature of the nitrogen gas inside of the rotary tunnel 18. The system 10 can include a vent 62 in the re-circulating loop 54 to vent excess nitrogen from the system. Circulation can be effected using a fan 64, driven by a suitable fan motor 66, which is included in the re-circulating loop 54.

Nitrogen is one of many cryogenic fluids that can be used to practice the present invention. Others would include, inter alia, helium, argon, and carbon dioxide.

It is believed that silicon dioxide ($SiO_2$) forms a hydrated gel on the surface of a sand grain. When the silicon dioxide is cooled quickly enough this hydration sphere shrinks and shears at the surface causing the binder to dissociate from the silicon particles. Once the dissociation is effected, removal of the binding material from the surface of the sand particles can be done by mechanical attrition.

As stated above another mechanism effective to produce the desired result with the present invention is the dynamic expansion of water as ice forms at the low temperature. The difference in expansion and contraction of the water and the clay causes an ablation of the clay from the silica as the bond is shattered. The de-bonding of the clay and the silica happens at a very low energy state and thus damage to any of the sand grains is minimal. Originally it was believed that the sand could be treated by contact with a cryogen (e.g. liquid nitrogen) in a muller to remove the clay in much the same way the sand is coated with the clay to begin with. While this shearing action did remove clay, there was no way to totally extract the removed clay and the seacoal, after processing, from the bowl of the muller. As the sand returns to room temperature the clay re-activates and attaches itself to the sand grains, thus returning the sand to the condition it was in during the pretreatment stages, minus any clay or seacoal particles that were removed as a result of the high surface tension of liquid nitrogen, that, in effect, suspended the particles when the liquid nitrogen evaporates. Thus, the sand must be subject to separation of the binder and other additives at a temperature below −40° C. (−40° F.) and preferably at or below −80° C. (−112° F.).

In one process simulation of the invention, green sand was cooled by spraying liquid nitrogen into the sand muller as the sand was being mulled. This process resulted in removing a large quantity of the clay, e.g. up to 60 to 70 percent. However, the amount of liquid nitrogen required to treat the sand would not make an economical practice since it took about 3 hours to bring the sand from room temperature down to −80° C. (−112° F.). The amount of clay removed during the first trial was approximately 60 to 65 percent. Another test was conducted using a rotary tunnel to cool the sand to the appropriate temperature. The sand was placed in rotary tunnel and allowed to remain there until it reached the appropriate temperature. After the sand reached the processing temperature (e.g. −80° C., −112° F.) it was transferred to a muller cooled to −80° C. (−112° F.) and processed, with samples drawn off at 15 minute intervals for the next 1 and ¼ hours. Microscopic examination of the samples revealed decreasing amounts of clay in the samples.

The tests revealed that between approximately 1 and 15% water (preferably 6 and 10 percent water) by weight must be present in the foundry sand presented for reclamation by the process of the present invention. The temperature of the sand prior to the attrition and recovery steps should be below −40° C. (−40° F.) and preferably below −80° (−112° F.).

It is critical that the clay fines be removed before the temperature of the material goes above 0° C. otherwise the clay will re-hydrate and reattach itself to the sand particles.

Since green sand for processing in a sand reclamation system normally contains resin bonded sand from the coring process, a successful treatment must include processing these mixtures at low temperatures using cryogenic cooling, laboratory experiments were also conducted on resin bonded sand systems used for molding and coremaking. Resin bonded sands were subjected to low temperature treatment using cryogenic techniques under the same conditions as that used for treatment of green sand systems. Low temperature treatment of these systems demonstrated that resin or adhesive coatings can be successfully removed. Low temperature treatment of the thermoplastic or thermoset resin systems which may or may not contain water results in embrittlement of the resins which when subjected to attrition of mechanical scrubbing allows separation of the resin from the sand. In addition to embrittlement, it is believed that cryogenic temperatures create adhesion failures of the resin at the sand/binder interface, thus enabling easy removal of the resin from the surface of the sand.

According to the present invention the green sand (e.g. clay binder) and core sand (e.g. chemical or resin binders) can be mixed together for treatment by the process of the present invention to recover a sand that can be reused as either a molding sand or a core sand.

Having thus described our invention as illustrated and described herein with reference to certain specific embodiments, the present invention is nevertheless not intended to be limited to the details shown. Further, various modifications may be made in the details within the scope of the invention desired to be secured by letters patent of the United States as set forth in the appended

What is claimed is:

1. A method for reclaiming sand from a foundry sand containing a clay binder, with or without used cores and other additives, comprising the steps of:

accumulating said foundry sand for further processing, said foundry sand being one of, foundry sand containing approximately 1% to 15% by weight water, or foundry sand treated to have approximately 1% to 15% by weight water;

cooling said foundry sand to a temperature of −40° C. (−40° F.) or below;

separating said sand from said clay binder and/or additives while maintaining the temperature of said foundry sand at a temperature at or below 0° C. (32° F.); and recovering said sand for reuse.

2. A method according to claim 1 including the step of subjecting said cooled foundry sand to an attrition step to enhance separation of said sand from said clay.

3. A method according to claim 1 wherein said cooling is effected by contacting said foundry sand with one of a gaseous or liquid cryogen.

4. A method according to claim 1 wherein said cooling is effected by heat exchange of nitrogen at cryogenic temperature with said foundry sand.

5. A method according to claim 1 wherein said cooling is effected by contacting said foundry sand with a gas cooled by mechanical refrigeration.

6. A method according to claim 1 wherein said foundry sand is recovered by one of screening or fluid classification.

7. A method according to claim 1 wherein said reclaimed sand has a clay content of about 1% or less.

8. A method according to claim 1 wherein said cooled foundry sand is conveyed to a recovery system wherein sand, binders and, additives are recovered as separate fractions.

9. A method for reclaiming sand from a foundry sand containing a clay binder with or without used cores and other additives, comprising the steps of:

accumulatin said foundry sand for further processing, said foundry sand being one of, foundry sand containing approximately 1% to 15% by weight water or foundry sand treated to have approximately 1% to 15% by weight water, cooling said foundry sand to a temperature at or below −40° C.;

subjecting said cooled sand to a treatment to liberate said sand from said binder and/or additives while maintaining said sand at a temperature at or below −40° C.; and recovering said sand from said binder.

10. A method according to claim 9 wherein said cooling is effected by contacting said foundry sand with one of a gaseous or liquid cryogen.

11. A method according to claim 9 wherein said cooling is effected by heat exchange of nitrogen at cryogenic temperature with said foundry sand.

12. A method according to claim 9 wherein said treatment to liberate said sand from said binder is by attrition.

13. A method according to claim 9 wherein said cooling is effected by cooling a gas by mechanical refrigeration means.

14. A method according to claim 9 wherein said foundry sand is recovered by one of screening or fluid classification.

15. A method according to claim 9 wherein said foundry sand is cooled to a temperature at or below −80° C.

16. A method according to claim 9 wherein said reclaimed sand has a clay content of about 1% or less.

17. A method according to claim 9 wherein said cooled foundry sand, after treatment to liberate said sand from said binder by impact, is conveyed to a recovery system wherein sand, binders and, additives are recovered as separate fractions.

* * * * *

UNITED STATES PATENT AND TRADEMARK OFFICE

CERTIFICATE OF CORRECTION

PATENT NO. : 5,992,499

DATED : November 30, 1999

INVENTOR(S) : Tordoff et al

It is certified that error appears in the above-identified patent and that said Letters Patent is hereby corrected as shown below:

Column 1, line 36, delete "regors" and substitute therefor --rigors--.

Column 5, line 36, delete "aparator" and substitute therefor --apparatus--.

Column 6, line 24, delete "cvooled" and substitute therefor --cooled--.

Column 9, line 15, delete "accumulatin" and substitute therefor --accumulating--.

Signed and Sealed this

Nineteenth Day of December, 2000

*Attest:*

Q. TODD DICKINSON

*Attesting Officer*

*Commissioner of Patents and Trademarks*